US005249699A

United States Patent [19]

Williams

[11] Patent Number: 5,249,699

[45] Date of Patent: Oct. 5, 1993

[54] HAZARDOUS MATERIAL CONTAINER

[75] Inventor: G. Lee Williams, Leawood, Kans.

[73] Assignee: Regal Plastics Co., Kansas City, Mo.

[21] Appl. No.: 733,330

[22] Filed: Jul. 22, 1991

[51] Int. Cl.[5] ..... B65D 19/00

[52] U.S. Cl. ..... 220/571; 206/386; 206/596; 108/51.1; 108/55.1

[58] Field of Search ..... 206/386, 596; 108/51.1, 108/55.1, 55.3; 220/DIG. 6, 571

[56] References Cited

U.S. PATENT DOCUMENTS

| | | | |
|---|---|---|---|
| 3,848,546 | 11/1974 | Lawlor | 108/51.1 |
| 3,895,588 | 7/1975 | Miller | 108/55.3 |
| 4,478,156 | 10/1984 | Andersson | 108/55.3 |
| 4,838,178 | 6/1989 | Chriske et al. | 108/51.1 |
| 4,930,632 | 6/1990 | Ecker et al. | 206/599 |
| 5,020,667 | 6/1991 | Bush | 206/599 |
| 5,036,976 | 8/1991 | Sechler et al. . | |
| 5,092,251 | 3/1992 | Hamaker et al. | 108/901 |
| 5,092,252 | 3/1992 | Gillhart | 108/55.3 |

*Primary Examiner*—Joseph Man-Fu Moy

*Attorney, Agent, or Firm*—Kokjer, Kircher, Bowman & Johnson

[57] ABSTRACT

A device for containing spills and leaks of hazardous chemicals includes a tray having upwardly extending side walls to define a cavity in which the leaked chemicals may be contained. The bottom of the tray includes grooves formed therein and adapted to allow the tray to be lifted and moved by a forklift or pallet jack. Additional reinforcing grooves may also be formed in the tray bottom. The side walls which extend parallel to the forklift grooves include a series of depressions adapted to receive and retain the ends of support bars which extend across the cavity of the tray to support a pallet thereon. The upper edges of the support bars are vertically below the upper edge of the side walls such that the side walls block undue movement of a pallet resting upon the support bars. The support bars may include support columns extending downwardly to the bottom of the tray to remove the load from the sidewalls and forklift grooves during use.

18 Claims, 2 Drawing Sheets

HAZARDOUS MATERIAL CONTAINER

BACKGROUND OF THE INVENTION

Field of the Invention

The present invention relates in general to containers for hazardous materials. In particular, the present invention relates to an improved container for the containment of hazardous chemicals which are customarily shipped and handled on pallets.

Description of the Related Art

Various devices have been known for containing the leaks or spills from hazardous chemical containers such as steel or plastic drums. These devices have taken the general shape of a tub in which the chemical container or containers are placed. Many of these devices have included a platform or support within the tub upon which the containers may be placed. However, this arrangement does not take into account that the containers are typically shipped and moved, due to their bulk and weight, upon pallets. While the containers may still be moved on pallets, they must first be lifted from the deck of the devices and placed on the pallet.

One effort to avoid this problem is described in U.S. Pat. No. 4,930,632 to Eckert et al. This device includes a tub having either a support contained therein or integral protrusions which act as a support, with the chemical containers resting upon a standard pallet, which in turn rests upon the support in the tub. In both cases the upper surface of the support is vertically higher than the walls of the tub such that a standard forklift may be used to place and remove the loaded pallet on the support. The tub also includes fork channels on its bottom such that the entire tub, pallet and chemical containers may be lifted and moved by a forklift.

SUMMARY OF THE INVENTION

An object of the present invention is to provide a storage device for chemical containers which will contain leaks and spills from the containers.

Another object of the present invention is to provide such a device which may be employed with the chemical containers retained upon a standard pallet, and which may be moved by a standard forklift.

A further object of the present invention is to provide such a device which securely retains the pallet, and therefore its load, during transport.

Yet another object of the present invention is to provide such a device which has a simple and light weight support for the pallet.

These and other objects are achieved by a device for containing spills and leaks of hazardous chemicals. The device includes a tray having upwardly extending side walls to define a cavity in which the leaked chemicals may be contained. The bottom of the tray includes grooves formed therein and adapted to allow the tray to be lifted and moved by a forklift or pallet jack. Additional reinforcing grooves may also be formed in the tray bottom. The side walls which extend parallel to the forklift grooves include a series of depressions adapted to receive and retain the ends of support bars which extend across the cavity of the tray to support a pallet thereon. The upper edges of the support bars are vertically below the upper edge of the side walls such that the side walls block undue movement of a pallet resting upon the support bars. The support bars may include support columns extending downwardly to the bottom of the tray to remove the load from the sidewalls and forklift grooves during use.

BRIEF DESCRIPTION OF THE DRAWINGS

The objects and features of the invention noted above are explained in more detail with reference to the drawings in which like reference numerals denote like elements, and in which:

FIG. 7 is a bottom view of a second embodiment of the present invention.

DETAILED DESCRIPTION OF THE INVENTION

Figure 1:
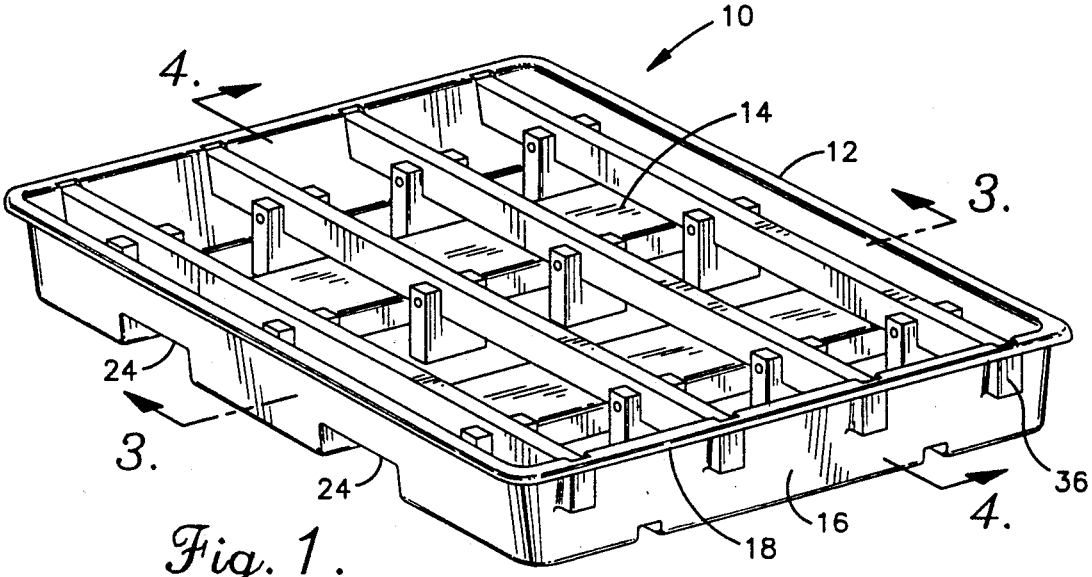
FIG. 1 is a perspective view of the device according to the present invention.

With reference to FIG. 1, the device according to the present invention is generally designated by reference numeral 10. Device 10 includes a tray 12 which has a bottom 14, and side walls 16 extending upwardly from the periphery of the bottom. The side walls may be substantially vertical, or may be angled slightly outward from the bottom. A peripheral lip 18 may be formed at an upper edge of the side walls to provide a grip for manually moving the tray.

The tray is preferably of a size and configuration such that a standard pallet 20 used to support and convey containers of chemicals will fit within the periphery of at least the upper edge of the side walls. For the type of pallets currently employed, the tray is preferably square with side wall lengths of approximately 141 cm. (55.5 inches) and a height of approximately 25 cm. (10 inches). With these dimensions the tray will hold approximately 333 liters (88 gallons), which is in excess of the entire contents of a currently-standard 55 gallon (208 liter) drum 22.

Figure 5:
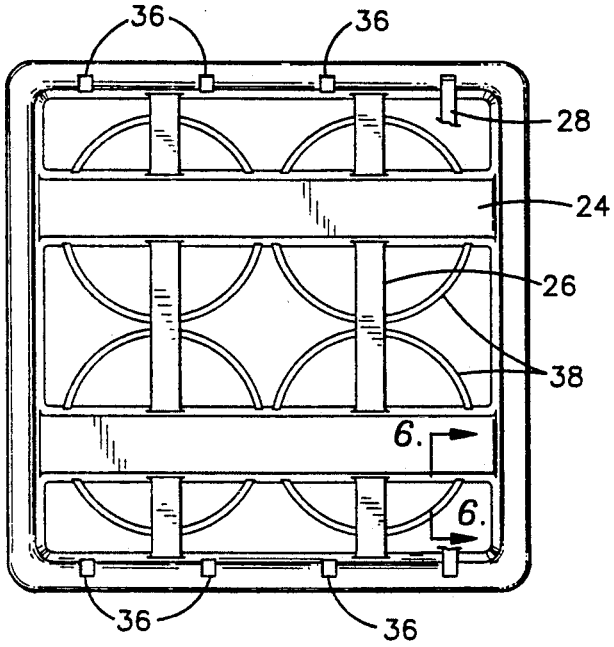
FIG. 5 is a top view of the device.

The bottom 14 includes a pair of fork channels 24 which extend substantially perpendicular to, and open into, at least one of the walls 16. The fork channels are sized and spaced to accommodate the forks of a standard fork lift or pallet jack. Where the tray is substantially square to conform to a standard pallet, the fork channels will extend substantially perpendicular to, and open into, a first pair of opposed walls 16, and be substantially parallel to the other pair of opposed walls 16. With this arrangement the forks of a fork lift may be inserted from two opposite sides of the tray 12. As is best shown in FIGS. 5 and 7, the ends of the fork channels which open onto the side walls may include a slight outward tapering to assist in guiding the forks into the fork channels.

The bottom 14 also includes at least one, and preferably two, reinforcing channels 26. These channels 26 have a depth and width smaller than that of the fork channels, and extend substantially perpendicular thereto. As such, where the tray is square, the reinforcing channels will extend between, and open into, the other pair of opposed walls 16, and will also open into the fork channels 24.

While the tray 12 could support the pallet 20 therein with the pallet resting upon the upper faces of the fork channels, this would place the sides of the fork channels under compression for extended periods during use. It is therefore preferred that the device 10 include a separate pallet support means within the tray 12.

The pallet support means may take the form of at least two, and preferably four spaced support bars 28 extending substantially parallel to each other and to the bottom 14, and at an angle to the fork channels 24. Where the tray is formed as a square, the support bars preferably extend substantially perpendicular to the fork channels 24. The support bars are spaced upwardly from the bottom 16 by a plurality of support columns 30 associated with each of the support bars.

The support columns space the support bars from the bottom a distance such that the lower faces of the support bars just touch the upper faces of the fork channels. In this manner, the support bars and columns transfer the weight of the pallet and its contents to the bottom 16, rather than the fork columns, when the device is resting upon the ground. However, when the device is lifted by a fork lift, the weight of the pallet and its contents is transferred through the support bars to the upper face of the fork channels, with little, if any, force being applied to the bottom via the support columns. This ensures that little or no force is applied to the upstanding portions of the tray, which greatly reduces material fatigue and cracking, thus extending the life of the device.

The support columns may be fixed to the support bars in any manner which provides a secure connection. As shown in the figures, each column may include a notch therein to receive the associated bar, resulting in column extensions 32 extending upwardly from the column along opposed sides of the support bar. A bolt 34 may then be extended through the column extensions and the associated support bar to fix the support column to the support bar with the application of an appropriate nut to the bolt. Alternatively, the lower edge of the support bar may also include a shallow notch which interlocks with the notch in the support column, providing an even stronger connection.

Figure 2:
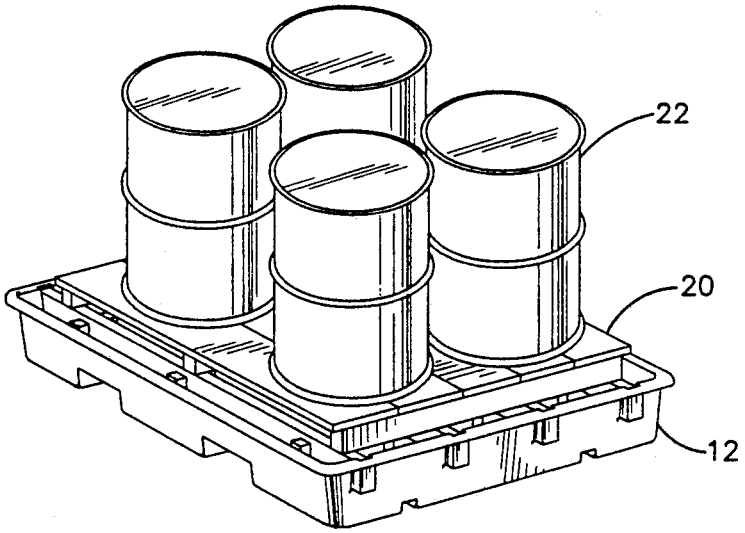
FIG. 2 is a perspective view of the device with a pallet and chemical containers resting thereon.
Figure 3:
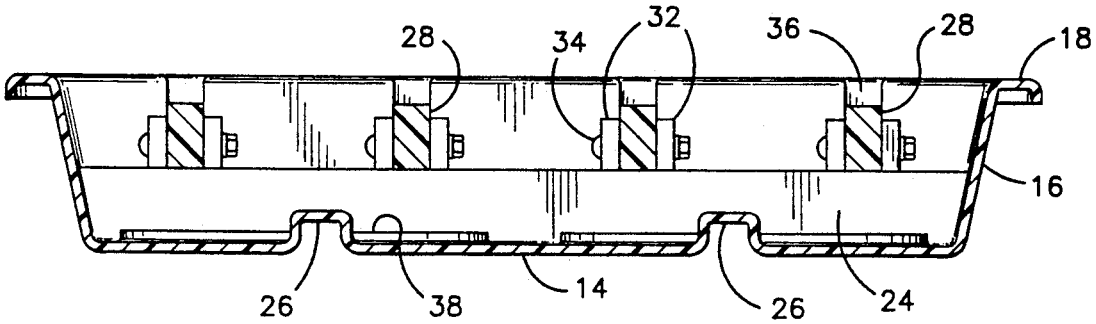
FIG. 3 is a cross-sectional view taken along line 3—3 of FIG. 1.
Figure 4:
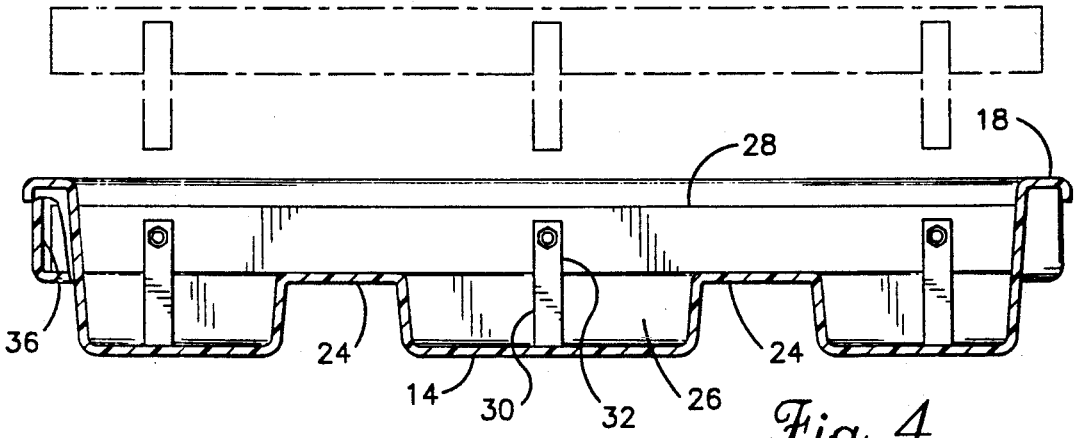
FIG. 4 is a cross-sectional view taken along line 4—4 of FIG. 1.

An important feature of the present invention is the vertical height of the side walls with respect to the pallet support means. As is best shown in FIGS. 2 and 4, when support bars and columns are employed, the upper faces of the support bars, which contact the bottom of the pallet, are located below the upper extent of the peripheral lip 18. The vertical distance between the upper extent of the peripheral lip and the upper face of the support bar is chosen such that the forks of a forklift will have a slight clearance to be inserted in and removed from an operative position below the upper layer of boards of the pallet, while at least a portion of the lower layer of boards of the pallet are restrained from excessive movement parallel to the bottom of the tray by the side walls 16.

This arrangement allows a forklift to be employed to load the tray, but at the same time reduces the chances of a pallet and its contents sliding off a tray when the combination is moved with a forklift. Additionally, this ensures that the entire periphery of the pallet is within the periphery of the side walls of the tray, such that any chemicals seeping along the pallet will drip within the tray, rather than over the side wall.

While the support bars 28 and support columns 30 may be readily envisioned as providing support for the pallet in the vertical direction, it is necessary to fix the support bars with respect to the tray 12 to ensure they do not fall to an inoperative position during placement of the pallet or movement of the loaded device. To effect this, the present invention provides a means for limiting motion of the support bars in directions parallel to the bottom of the tray, with this means being integral with the tray.

As is best shown in FIGS. 1, 4 and 5, the sides of the tray include support cavities 36 which receive the longitudinal ends of the support bars. A support cavity is provided for each end of each support bar, and the support cavities preferably open upwardly into the associated side wall such that the support bars and their associated support columns may be placed into, and removed from, the support cavities. The support bars have a sufficient length and width with respect to the size and placement of the support cavities that the ends of the support bars are received therein with a slight tolerance to allow easy insertion and removal from the support cavities, yet not allow undue movement of the support bar when received within the cavity.

While the support cavities may be separate members mounted on the interior of the side walls, it is preferred that the cavities be integrally formed within the side walls. This reduces the amount of material required to form the device, thus saving resources, and also reduces the manufacturing costs for the tray. Additionally, this arrangement eliminates the need for fasteners for securing the support cavities, especially those which extend through the tray, which may weaken the tray material, leading eventually to the chemicals leaking from the tray.

Figure 6:
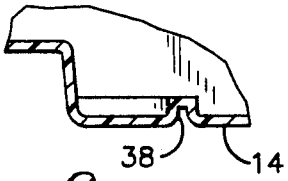
FIG. 6 is a cross-sectional detail view taken along line 6—6 of FIG. 5.
Figure 8:
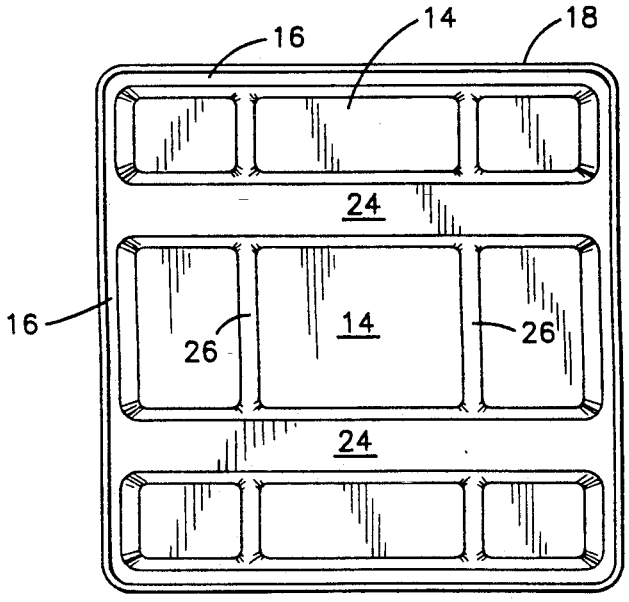

As is best shown in FIGS. 5 and 6, the bottom of the tray may also include nesting ribs 38 extending upwardly therein. The nesting ribs have a circular configuration, and are arranged in a pattern, corresponding to that of drums typically stored upon pallets within the tray 12. With this arrangement a further tray 12 may be placed upon the upper edges of such barrels, with the peripheral rims of the barrels being received within the nesting ribs 38. A further pallet supporting additional containers may thus be stored upon the upper tray 12, allowing a larger amount of material to be stored within the same amount of floor space. It should be noted, however, that the stacking of containers may be a dangerous practice with hazardous chemicals, is not recommended, and in fact is prohibited by regulation in several states.

Since the device of the present invention is typically to be used with, and to contain spills of, hazardous chemicals, the device should of course be formed of materials which are impervious to such chemicals. High density or high molecular weigh polyethylene are especially suited for such applications, although any material providing light weight, low cost, ruggedness and no reaction with the intended chemicals may be employed.

It is also preferred that the support bars and columns be formed of the same or a similar material as the tray. These members may therefore be formed from extruded or molded bars of high density polyethylene. Since it is often desirable to incinerate a tray which has contained a spill, it may be preferred to form the entire device of materials which may be incinerated. In such a case, the support columns and bars may be molded as a monolithic unit, or may be attached together by adhesives or molten plastic. This would eliminate the metal bolts and nuts, which may not be readily incinerated.

From the foregoing it will be seen that this invention is one well adapted to attain all ends and objects herein above set forth together with the other advantages which are obvious and which are inherent in the structure.

It will be understood that certain features and subcombinations are of utility and may be employed without reference to other features and subcombinations. This is contemplated by and is within the scope of the claims.

Since many possible embodiments may be made of the invention without departing from the scope thereof it is to be understood that all matter herein set forth or shown in the accompanying drawings is to be interpreted as illustrative and not in a limiting sense.

What is claimed is:

1. A device for containing hazardous materials, comprising;

a tray having a bottom and at least one side wall extending about the periphery of said bottom and extending upwardly to an upper periphery, said bottom including at least two fork channels adapted to receive the forks of a forklift whereby said tray may be lifted by the forklift, and said tray including means for supporting a pallet within said tray, said means having an upper face which is vertically lower than said upper periphery, and said means comprising at least a pair of support bars, each located within the extent of, and extending between spaced locations along, said upper periphery, said support bars having an upper face which is vertically lower than said upper periphery, and a plurality of support columns associated with each of said support bars, said support columns having a lower end resting upon said bottom of said tray and an upper end connected to said associated support bar.

2. A device as in claim 1, wherein said means for supporting a pallet comprises at least a pair of support bars located within the extent of said upper periphery, said support bars having an upper face which is vertically lower than said upper periphery.

3. A device as in claim 2, wherein said means further comprises a plurality of support columns associated with each of said support bars, said support columns having a lower end resting upon said bottom of said tray and an upper end connected to said associated support bar.

4. A device as in claim 1, wherein each said support bar includes a lower face in close proximity to an upper face of said fork channels and said tray is formed of an at least slightly elastic material, whereby lifting of said tray by the forklift causes said support bars to be directly supported upon said upper face of said fork channels.

5. A device as in claim 4, wherein said bottom has a substantially square peripheral configuration, said at least one side wall comprises four side walls, said fork channels comprise two substantially parallel fork channels spaced from each other and extending between and opening into a first opposed pair of said side walls, said support bars are spaced from each other and extend substantially perpendicular to said fork channels, and further comprising at least one reinforcing channel formed in said bottom and extending substantially perpendicular to said fork channels.

6. A device as in claim 1, wherein said at least one side wall includes a pair of support cavities associated with each of said support bars, said support cavities receiving longitudinal end portions of said associated support bar and restricting movement of said end portions at least in two directions which are substantially perpendicular to the longitudinal axis of said support bar and substantially parallel to the plane of said bottom.

7. A device as in claim 6, wherein said means further comprises a plurality of support columns associated with each of said support bars, said support columns having a lower end resting upon said bottom of said tray and an upper end connected to said associated support bar.

8. A device as in claim 6, wherein said support bar includes a lower face in close proximity to an upper face of said fork channels and said tray is formed of an at least slightly elastic material, whereby lifting of said tray by the forklift causes said support bars to be directly supported upon said upper face of said fork channels.

9. A device as in claim 8, wherein said bottom has a substantially square peripheral configuration, said at least one side wall comprises four side walls, said fork channels comprise two substantially parallel fork channels spaced from each other and extending between and opening into a first opposed pair of said side walls, said support bars are spaced from each other and extend substantially perpendicular to said fork channels, said support cavities are located on the other opposed pair of said side walls, and further comprising at least one reinforcing channel formed in said bottom and extending substantially perpendicular to said fork channels.

10. A device as in claim 6, wherein said support cavities are integrally formed as depressions within said at least one side wall.

11. A device as in claim 10, wherein said bottom, sidewalls, and support cavities are formed as a monolithic unit.

12. A device as in claim 11, wherein said monolithic unit is formed of high density polyethylene.

13. A device as in claim 1, wherein the pallet intended to be supported by said means to support a pallet includes upper and lower layers fixed in spaced opposed position and adapted to receive the forks of the forklift therebetween, a layer distance between the layers being greater than the vertical thickness of the forks of the forklift adapted to be employed with the pallet, and wherein said upper face of said means is vertically lower than said upper periphery by a tray distance which is less than the layer distance minus the vertical thickness of the forks, yet a sufficient fraction of a thickness of the pallet lower layer such that said side wall acts as an abutment against movement of the lower layer beyond the extent of said upper periphery.

14. A device for containing hazardous materials, comprising:

a tray having a bottom and at least one side wall extending about the periphery of said bottom and extending upwardly to an upper periphery, said bottom including at least tow fork channels adapted to receive the forks of a forklift whereby said tray may be lifted by the forklift;

at least a pair of support bars located within the extent of said upper periphery, each said support bar having an upper face adapted to support a pallet, and a lower face; and wherein said at least one side wall includes a pair of support cavities associated with each of said support bars, said support cavities receiving longitudinal end portions of said associated support bar and restricting movement of said end portions at least in two directions which are substantially perpendicular to the longitudinal axis of said support bar and substantially parallel to the plane of said bottom, said support cavities having a bottom upon which said lower face of said respective longitudinal ends of said support bars rest, said support cavities being located within said side wall at a vertical height such that said lower face of each said side bar abuts against an upper face of said fork channels.

15. A device as in claim 14, wherein said support cavities are integrally formed as depressions within said at least one side wall.

16. A device as in claim 15, wherein said bottom, sidewalls, and support cavities are formed as a monolithic unit.

17. A device as in claim 16, further comprising a plurality of support columns associated with each of said support bars, said support columns having a lower end resting upon said bottom of said tray and an upper end connected to said associated support bar.

18. A device as in claim 17, wherein said bottom has a substantially square peripheral configuration, said at least one side wall comprises four side walls, further including two substantially parallel fork channels spaced from each other and extending between and opening into a first opposed pair of said side walls, said support bars being spaced from each other and extending substantially perpendicular to said fork channels, and said support cavities being located on the other opposed pair of said side walls.

* * * * *